US008845502B2

(12) United States Patent
Keller

(10) Patent No.: US 8,845,502 B2
(45) Date of Patent: Sep. 30, 2014

(54) CONTROL FOR A MACHINE FOR THE MANUFACTURE OF PAPER PADDING

(75) Inventor: Reinhard Keller, Dättlikon (CH)

(73) Assignee: Pack-Tiger GmbH, Dattlikon (CH)

( * ) Notice: Subject to any disclaimer, the term of this patent is extended or adjusted under 35 U.S.C. 154(b) by 1713 days.

(21) Appl. No.: 10/575,544

(22) PCT Filed: Oct. 7, 2004

(86) PCT No.: PCT/EP2004/011224

§ 371 (c)(1),
(2), (4) Date: May 18, 2006

(87) PCT Pub. No.: WO2005/035233

PCT Pub. Date: Apr. 21, 2005

(65) Prior Publication Data

US 2008/0167171 A1 Jul. 10, 2008

(30) Foreign Application Priority Data

Oct. 8, 2003 (DE) ..... 103 46 629

(51) Int. Cl.
*B31B 49/00* (2006.01)
*B65B 3/00* (2006.01)

(52) U.S. Cl.
CPC ..... *B65B 3/003* (2013.01); *B31D 2205/0088* (2013.01); *B31D 2205/0058* (2013.01)
USPC ..... 493/30; 493/350; 700/122

(58) Field of Classification Search
CPC ..... B31B 49/00
USPC ..... 493/30, 350; 700/122
See application file for complete search history.

(56) References Cited

U.S. PATENT DOCUMENTS

| | | | | |
|---|---|---|---|---|
| 3,603,216 | A * | 9/1971 | Johnson | 493/359 |
| 4,161,298 | A | 7/1979 | Davis | |
| 4,174,237 | A | 11/1979 | Hemming, Jr. et al. | |
| 4,237,776 | A | 12/1980 | Ottaviano | |
| 4,619,635 | A | 10/1986 | Ottaviano | |
| 4,781,090 | A | 11/1988 | Feldkamper et al. | |
| 4,922,687 | A | 5/1990 | Chow et al. | |
| 5,571,067 | A * | 11/1996 | Ratzel | 493/30 |
| 5,897,478 | A | 4/1999 | Harding et al. | |
| 6,077,209 | A | 6/2000 | Armington et al. | |
| 6,179,762 | B1 | 1/2001 | Harding et al. | |
| 6,273,360 | B1 * | 8/2001 | Robinson | 242/596.7 |
| 6,398,703 | B1 | 6/2002 | Keller | |
| 2003/0073558 | A1 * | 4/2003 | Chesterson et al. | 493/250 |
| 2003/0114288 | A1 * | 6/2003 | Harding et al. | 493/464 |

FOREIGN PATENT DOCUMENTS

| | | |
|---|---|---|
| EP | 0 776 760 B1 | 5/1999 |
| EP | 0 785 862 B1 | 6/2003 |
| WO | WO 96/03274 | 2/1996 |
| WO | WO 99/21702 | 5/1999 |
| WO | WO 00/07808 | 2/2000 |
| WO | WO-2004/041527 A1 | 5/2004 |

* cited by examiner

*Primary Examiner* — Tejal Gami
(74) *Attorney, Agent, or Firm* — Gifford, Krass, Sprinkle, Anderson & Citkowski, P.C.

(57) ABSTRACT

The invention relates to a control for a machine for producing paper padding material. The machine comprises a drive motor which transports sheets of paper through a shaping device. In this shaping device, the sheets of paper are shaped to paper padding material which is then cut to the desired length in a cutting device. The inventive control allows for an automatic memorization of a manually selected storage length.

16 Claims, 1 Drawing Sheet

CONTROL FOR A MACHINE FOR THE MANUFACTURE OF PAPER PADDING

CROSS-REFERENCE TO RELATED APPLICATIONS

This application is a National Stage of International Application No. PCT/EP2004/011224, filed Oct. 7, 2004, which claims priority to German Patent Application No. 103 46 629.0 filed on Oct. 8, 2003. The disclosures of the above-identified applications are incorporated herein by reference.

FIELD OF THE INVENTION

The invention relates to a control for a machine for the manufacture of paper padding or to a machine for the manufacture of paper padding having a control of this type.

BACKGROUND OF THE INVENTION

Paper padding is used in large volumes for the packing of goods for shipping and serves for the protection of the good to be shipped. It has the advantage with respect to the likewise relatively widespread plastic padding with air bubbles that paper has a substantially better environmental compatibility. Machines for the manufacture of paper padding are already known in different embodiments.

Generally, a machine of this type can include a feeder store which consists of one or more rolls having single-layer or multilayer paper webs, a shaping device which shapes the paper webs by rolling in the side edges to form strips of padding, a connection device which connects the strips of padding in the central region by means of stamping, a cutting device which cuts padding off from the strips of padding, a drive device for the driving of the connection device and of the cutting device and a control which controls the machine in accordance with the settings.

SUMMARY OF THE INVENTION

It is the underlying object of the invention to improve a control for a machine for the manufacture of paper padding with respect to a simple operability and manufacture.

This object is satisfied by a control for a machine for the manufacture of paper padding, with the machine comprising a drive motor with a cutting device and a shaping device to shape padding from a paper web and to cut it off in a desired length. The control comprises an input means for the inputting of a desired length of padding and a control unit with a memory for the control of the drive motor in response to the input means. An activation of the input means starts the drive motor and a deactivation of the input means stops the drive motor and triggers a cutting procedure so that the duration of the activation of the input means corresponds to the length of padding produced. For example, a user can actuate the input means, for example a push button, and as long as the push button is actuated, paper padding is produced by the machine. When the paper padding has reached the length desired by the user, he releases the push button so that the drive motor stops, the cutting device is actuated and a piece of paper padding is produced in the desired length.

In accordance with the invention, the control unit automatically stores the length of padding produced on the deactivation of the input means in the memory and makes this length of padding available for a further call up. In other words, the control remembers the length of padding generated by manual actuation of the input means so that it can be reproduced on request.

Advantageous embodiments of the invention are described in the following description, in the drawing and in the dependent claims.

In accordance with a first advantageous embodiment, the stored length of padding can be called up from the memory by an actuation, in particular a brief actuation, of the input means or of a further input means, with the manufacture of at least one further piece of padding being triggered automatically in the called up length when the length of padding is called up. For example, a further piece of padding can be called up in the previously automatically stored length in that the push button is only pressed briefly, whereupon a further piece of padding in the same length is produced. It is furthermore possible by a further input means or by the same input means, for example by a double pressing, to effect a continuous production of pieces of padding in the automatically stored length.

In accordance with a further advantageous embodiment of the invention, the input means can be a single switch or push button, with an input pad being provided in addition to the switch or push button with which desired lengths of padding can be input into the control or called up from the control, with the manufacture of at least one piece of padding being triggered automatically in the called up length on the call up of a length of padding. In this embodiment, an input pad is provided in addition to the individual input means, for example a single push button, to call up preprogrammed lengths of padding, for example. In accordance with the invention, a piece of padding can thus be produced in a pre-programmed length by actuation of the input pad, whereas a piece of padding in the automatically stored length of padding can be produced by actuating the input means. This means that, in addition to the operation via the input pad, which usually has somewhat small input keys, the user can also effect the operation of the machine via the input means in the form of a separate push button which can be made correspondingly larger to permit a simple operability.

In accordance with a further advantageous embodiment, in the variant described above, a directly sequentially call up of a respective length of padding is possible with the switch or push button, on the one hand, and with the input pad, on the other hand, without a further input means of the control having to be actuated between these two call ups. In other words, the user can produce a piece of padding via operation of the push button and can produce a piece of padding via the operation of a key on the input pad alternately and without intermediate steps, which further simplifies the operation of the machine.

In accordance with a further embodiment of the invention, at least one additional switch or push button can be provided on whose actuation a standard length stored, i.e. preprogrammed, in the memory is called up, with the manufacture of at least one piece of padding being triggered automatically in the called up length on the call up of this length of padding. In this embodiment, the ease of operation for the user is further increased since an additional separate switch or push button is provided which permits a call up of a preprogrammed standard length so that the user does not have to operate the relatively small keys on the input pad to call up this standard length, but can rather make use of the additionally provided switch or push button which is dimensioned correspondingly large to permit a simple and fast actuation.

In accordance with a further advantageous embodiment, a display apparatus is provided, with a standard length of padding stored in the memory being displayed on the first switching on of the control, for example at the start of operation, said length of padding being able to be called up by a further input means, with the manufacture of at least one piece of padding being triggered automatically in the called up length on the call up of this length of padding. In this embodiment, the control provides a basic setting such that the user can immediately make use of this preset length of padding, which is shown in the display device, when the machine is switched on.

In accordance with a further advantageous embodiment of the invention, the control has a mode in which a combination of the desired number and of the desired length of pieces of padding to be produced can be stored or called up. This can be advantageous when a specific range of pieces of padding in different lengths is desired for specific packaging purposes.

In accordance with a further embodiment of the invention, an input means can be provided with which a continuous manufacture of padding can be activated in the length of padding automatically stored by the control. It is not necessary in this embodiment for the user always repeatedly to call up an individual piece of padding in the length automatically stored by the control. A continuous production can rather be triggered.

In accordance with a further advantageous embodiment of the invention, the individual switch or push button to start or stop the drive motor, the input pad and the input means for the actuation of a continuous manufacture are input means of equal priority for the call up of a length of padding, with the manufacture of at least one piece of padding being triggered automatically in the called-up length on the call-up of the length of padding. This embodiment has the large advantage that the user can actuate either the individual switch or push button, or the input pad or finally the input means for the actuation of a continuous manufacture—without any intermediate steps—to produce one or more pieces of padding. The user can alternate as desired between these three input means without a mode change, a change in operating modes or the like having to be made for this.

In accordance with a further advantageous embodiment, a selection switch is provided with which a plurality of memory locations in the memory can be selected, with a produced length of padding being able to be stored automatically at these memory locations. By actuating the selection switch, the user can thus store a just produced length of padding in one of a plurality of memory locations, whereby the ease of operation is further increased. In this process, the associated stored length of padding can be produced in dependence on the position of the selection switch on activation of the input means.

Alternatively, in accordance with a further advantageous embodiment, a further input means can respectively be associated with the plurality of memory locations to call up a length of padding stored at the respective memory location, with the manufacture of a least one piece of padding being automatically triggered in the called up length on the call up of the length of padding. For example, three memory locations can be provided and three push buttons can be provided in association with these three memory locations with which the lengths of padding stored at the memory locations can be called up. In this process, for example by a brief actuation of the push button, an individual piece of padding can be triggered in the stored length and, on a longer actuation of the push button, a continuous production of pieces of padding in the stored length can be triggered.

In accordance with a further advantageous embodiment, a sensor can be connected to the control which detects the forthcoming end of the paper web, with the control generating a signal in response to the sensor. This can, for example, be a warning signal which indicates the forthcoming end of the paper web to the user. However, an interruption signal can also be generated which has the effect that the control interrupts the operation of the machine at least temporarily. It can hereby be ensured that a new paper web can be inserted into the machine in such good time that the follow-up guidance of the paper web by the machine is possible in a simple manner.

Only one drive motor can be provided at the machine which can be used for the transporting of the paper web and also for the actuation of the cutting device. The cutting device must, however, always only be driven when a cutting procedure should take place. For this purpose, the machine can have a magnetic coupling which is activated at that point in time at which a cutting procedure should take place and which couples the cutting device to the drive motor. If the cutting procedure has taken place, the magnetic coupling is deactivated again and the cutting device is thus decoupled from the drive motor.

It results directly from the circumstance that the cutting device is coupled to the same drive motor in the cutting procedure which also effects the transport of the paper webs and that this drive motor transports paper webs continuously in an operating mode of the machine that only a very short period of time is available for the cutting procedure. To keep this period of time short, the magnetic coupling must therefore couple the cutting device to the drive motor in a very short time and the magnetic coupling must decouple the cutting device from the drive motor again in a very short time, with restoration taking place directly after the release of the cooperating coupling parts with the aid of mechanical means while accelerating.

Magnetic couplings of this type, which are conventional per se, have a coil which has to be supplied with a sufficient amount of energy very quickly on the coupling of the cutting device to the drive motor. On the coupling of the cutting device, a disk or a ring of the cutting device is namely pressed against a disk or a ring driven by the drive motor (by electromagnetic attraction forces) with the help of the coil. The disk of the cutting device is thus taken along for the time period in which the two disks or rings are pressed against one another, provided that the press-on force is large enough to transmit the torque from the disk or from the ring of the drive motor to the disk or the ring of the cutting device so that the disk or the ring of the cutting device cannot slip.

The disk of the cutting device can be connected to a compound lever which is actuated by the rotation of the disk or of the ring and which drives the blade of the cutting device through the strip of padding and thus cuts a piece of paper padding of a desired length from the strip of padding.

After the cutting has taken place, the blade must be retracted again very quickly since a continuous transport of strips of padding should be possible, which would be impeded by a long dwelling of the blade in the cutting position. For this purpose, however, the cutting device must be decoupled from the drive motor very quickly. At this point in time, however, there is a large amount of energy in the magnetic field of the coil as the coil has to be designed such that it generates a magnetic field which is sufficiently strong with a coupled cutting device to generate the press-on forces which transmit the torque of the drive motor to the disk or to the ring of the cutting device. On the switching off of the energy supply, the magnetic field of the coil is, however, not abruptly reduced due to the inductivity of the coil, because the inductivity counteracts this abrupt change of the energy supply of the coil.

For this purpose, the control of the machine is designed such that it immediately supplies the magnetic coupling (or the coil of the magnetic coupling) with the required amount of energy on the coupling so that the cutting device is immediately coupled to the drive motor and can transmit the torque immediately. Furthermore the control of the machine is, however, also designed such that it immediately drains off the energy from the magnetic coupling (or from the coil of the magnetic coupling) again after the end of the time period in which the blade of the cutting device has cut the strip of padding so that the blade can be immediately retracted from the cutting position again with the aid of mechanical restoring springs.

For this purpose, the control can comprise a feed unit and a power unit, with the feed unit providing the required energy to supply the coil of the magnetic coupling with the required energy at that point in time at which the coupling of the cutting device to the drive motor should take place with the help of the magnetic coupling. The power unit switches this energy immediately to the coil of the magnetic coupling. When the pre-settable time period has passed, which is required for the driving of the blade of the cutting device through the strip of padding, the power unit immediately drains the energy of the coil out of it again.

To provide the required energy, the feed unit advantageously comprises a step-up converter and the power unit is provided with a Tranzorb diode circuit for the draining of the energy from the coil.

Furthermore, the control can comprise an operating panel connected to the machine on which the respectively desired operating mode of the machine can be set directly by means of individual keys, without a separate mode switch being provided for this purpose as with the prior art. The operation of the machine is thereby further simplified.

In accordance with a further advantageous embodiment of the invention, the control has a connector for an electromagnetic coupling of an auxiliary unit, with the control controlling the drive motor differently in dependence on whether the electromagnetic coupling is connected or not. The auxiliary unit can, for example, be a winding apparatus which is coupled to the machine externally and which is controlled by the drive of the machine. To permit a coupling of the winding apparatus, the electromagnetic coupling provided for this purpose can then be controlled by the control, with the drive of the machine, in particular the pre-motion, the post-motion and the actuation of the blades, having to be controlled differently than when no electromagnetic auxiliary unit is provided on an operation of the winding apparatus.

The control preferably automatically recognizes whether an electromagnetic coupling is connected. Alternatively, the control can be switched manually, for example by actuation of keys of the input field.

Further possible auxiliary units are a conveyor belt, an auxiliary roller drive, winding aids and the like.

Furthermore, the control can also be provided with one or more remote controls with which the operation of the machine can be started in a specific mode or optionally ended. This is advantageous in that then the individual operating modes can be programmed at the operating field and the operators can afterward only start the manufacture of the pieces of paper padding or end it again from a different location (e.g. from the location of the output device for the pieces of paper padding) with the aid of the remote control.

It can be advantageous for this purpose to make the control as a separate operating part which is connected to the machine via a cable. It can in particular be advantageous to provide a holder on the machine for the releasable installation of the control.

In accordance with a further advantageous embodiment of the invention, a bus system is provided for the transmission of the control signals from the control to the machine and its components, for example the drive motor, the couplings and sensors. The advantage hereby results, on the one hand, that a plurality of operating parts can be coupled via the bus system; on the other hand, the connection cable between the control and the machine can be made substantially thinner since only leads for the voltage supply, the emergency-stop function and, otherwise, the bus control lines have to be provided.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

The control in accordance with the invention will be described purely by way of example in the following with reference to different embodiments. The control serves for the control of a machine for the manufacture of paper padding, with the machine comprising a drive motor having a cutting device and a shaping device to form a piece of padding from a paper web and to cut it off in a desired length. Machines of this type are generally known. Reference is made purely by way of example to the content of WO 99/36252 which is explicitly incorporated in this patent application by reference. Since machines of this type for the manufacture of paper padding are sufficiently familiar to the skilled person, the machine itself is not described in any more detail in this application.

Figure 1:
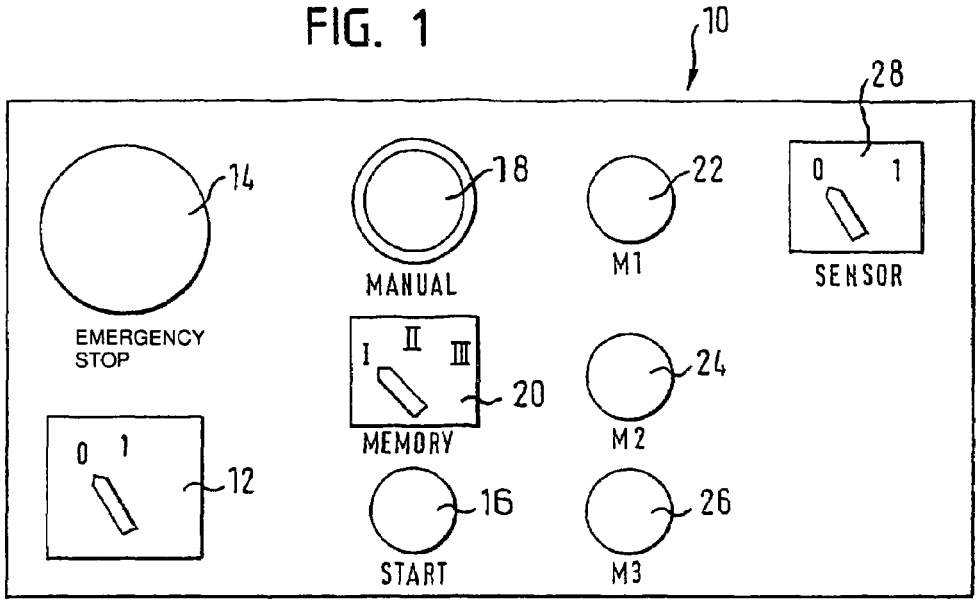
FIG. 1 illustrates an embodiment of a control in accordance with a first embodiment.

FIG. 1 shows a first embodiment of a control which is made as a semi-automatic unit. The control 10 shown in FIG. 1 has at its inside a control unit which is formed with the help of a microprocessor, is not shown in any more detail and has a memory which controls both the drive motor and the cutting device of the machine.

The control 10 shown in FIG. 1 has a main switch 12 and an emergency-off switch 14. Furthermore, a start push-button 16 is provided with which an initializing of the control 10 can be carried out, so that it is ready for operation, after actuation of the main switch 12. In contrast, the whole machine is deenergized with the main switch 12 and also with the emergency-off switch 14.

Reference numeral 18 designates a push button with an enlarged push-surface which serves as an input means for the control 10 to input a desired length of padding. On activation of the push button 18, the drive motor is started in a known manner and the manufacture of a piece of paper padding starts. After release of the push button 18, a cutting procedure is triggered and the drive motor is stopped so that the time period of the activation of the push button 18 corresponds to a specific length of padding.

The control 10 is made such that the length of padding produced by actuation and release of the push button 18 is stored automatically, i.e. in a self-acting manner and without a further push button pressure, in the memory of the control and is made available for a further call up. In this process, either the time can be determined during which the push button 18 is held depressed. Alternatively, the revolutions of the drive motor occurring during this period or the like can be determined by the control since these also correlate with the length of padding produced.

If the operator desires that a further piece of padding is manufactured in the length just produced, a brief pressing of the push button 18 is sufficient, whereupon the control calls up the value stored in the memory which corresponds to the length of padding just produced and produces a further piece of padding in this length.

For the further increase of the ease of operation, the control 10 has a selection switch 20 with which a plurality of memory locations in the memory of the control 10 can be selected. A respectively produced length of padding can be stored automatically in these memory locations, i.e. the length automatically stored by the control 10 is stored either in a memory location I, in a memory location II or in a memory location III in dependence on the position of the selection switch 20. To call up these three lengths of padding, the selection switch 20 only has to be set at the desired memory position. Subsequently, a brief pressing of the push button 18 is again sufficient so that the padding is produced in the desired length.

To achieve a continuous operation of pieces of padding in lengths of padding which correspond to the stored lengths I, II or III, three further push buttons 22, 24 and 26 are provided at the control 10 which permit a continuous manufacture of pieces of padding whose lengths correspond to the respectively stored lengths of padding I, II and III. If the user, for example, requires a continuous production of pieces of padding whose length corresponds to the stored length of padding II, an actuation of the push button 24 is sufficient. On a further actuation of the push button 24, or on an actuation of the selection switch 20, the continuous production is stopped.

In accordance with an alternative embodiment, it is also possible to call up the production of an individual piece of padding in the desired length of padding I, II or III by a brief pressing of the push buttons 22, 24 or 26. On a somewhat longer actuation of these push buttons, a continuous production then takes place.

It is understood that the number of memory locations in the embodiment of FIG. 1 is purely exemplary and that more or fewer than two memory locations can also be provided.

The control 10 shown in FIG. 1 furthermore has a sensor which detects the forthcoming end of the paper web, with the control 10 generating a signal in response to the sensor which temporarily interrupts a further operation of the machine so that a new paper web can be inserted into the machine at a sufficiently early time. To deactivate this sensor, a further switch 28 is provided at the control 10 with which the sensor can be switched off.

Finally, the control 10 is provided with a further sensor (not shown) which is provided between the drive wheel of the machine and the cutting device and which directly scans the piece of paper padding produced in this region. To the extent a paper jam should occur in this region, the control stops the drive motor so that the paper jam can be removed in good time before the paper wedges in the machine.

Figure 2:
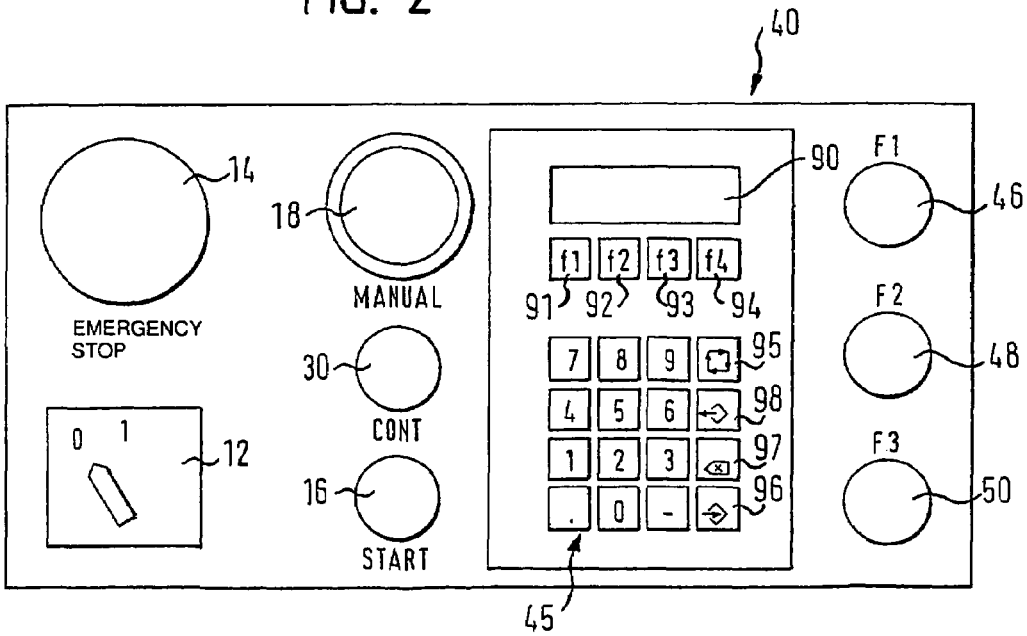
FIG. 2 illustrates an embodiment of a control in accordance with a second embodiment.

FIG. 2 shows a further embodiment of the invention which corresponds to the embodiment of FIG. 1 in its basic function, but which is made as a fully automatic unit. For this reason, the same reference numerals are used for components of the same action in the description.

The control 40 shown in FIG. 2 in turn comprises a main switch 12, an emergency-off switch 14 and a start push button 16. A push button 18 is in turn provided as the input means for the starting and stopping of the machine. In this respect, the design and the operation of the control 40 does not differ from the control 10.

In addition, however, an input pad 45 and a display 90 are provided in the control 40 with which further control functions can be called up. For example, different operating modes can be programmed with the aid of the input pad 45.

In FIG. 2, four function keys 91, 92, 93, 94 can furthermore be recognized with which different operating modes can be programmed. It is thus possible, for example, to map the function keys 91, 92, 93 with different programs which each produce a specific number of pieces of paper padding of a specific length as soon as the trigger key 95 has been actuated. For example, each function key can be mapped with up to eight different combinations of number and length of the pieces of paper padding to be manufactured, that is e.g. $f1=a1\times l1+a2\times l2+a3\times l3+a4\times l4+a5\times l5+a6\times l6+a7\times l7+a8\times l8$, where a1-a8 each designate the number of the pieces of paper padding and l1-l8 each designate the length of the pieces of paper padding. Each of the function keys 91, 92, 93 can be mapped with a program of this type.

The keys 96, 97 and 98 are confirmation keys or correction keys or delete keys which can confirm, correct or delete an input on programming. The other keys of the operating field shown in FIG. 3 are decimal number keys as well as a decimal point key and a minus key for a negative sign.

In addition to the function keys 91, 92 and 93 provided in the region of the input pad 45, three further push buttons 46, 48 and 50 are additionally provided next to the input pad 45 and are switched in parallel to the keys 91, 92 and 93 of the input pad 45. The ease of operation can hereby be further increased since the push buttons 46 to 50, which are designed of larger construction, are substantially easier and faster to operate than the relatively small keys 91 to 93 of the input pad 45.

Finally, a further push button 30 is provided at the control 40 with which a continuous production of the automatically stored length of padding is possible.

In the control 40 shown in FIG. 2, the push button 18 for the manufacture of an individual piece of padding, the push button 30 for a continuous production and the keys 91 to 93 of the input pad 45 and also the push buttons 46, 48 and 50 are of equal priority, i.e. each of these push buttons or keys can be actuated sequentially, without a further key of the control having to be actuated in between or a program change switch having to be actuated. Different preprogrammed lengths of padding or ranges of padding, i.e. different lengths of padding in a specific volume, can be called up with the aid of the input pad 45. It is also possible to program the control with the help of the input pad 45. When the control is switched on by actuating the start push button 16, a preset standard length of padding is shown in the display 90 which can then be called up by actuation of the key 91 of the input pad 45 or by actuation of the push button 46.

As can be seen from the above description, large-area mechanical push buttons 18 and 46-50 are provided in the control 40 in addition to the input pad 45 which are partly redundant to permit a fast and secure actuation of the machine.

If, for example, a program for the manufacture of specific lengths of padding has been carried out in the control 40, it is easily possible to change into the manual operating mode without switching a mode selection switch. Vice versa, it is also possible to change from the manual or semi-automatic operating mode into the fully automatic operating mode in which the stored program is carried out. This is also possible without a switching of a mode selection switch—in contrast to machines of the prior art where a separate mode selection switch has to be operated to change from one operating mode to another.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A control (10, 40) for a machine for the manufacture of paper padding, wherein the machine comprises a drive motor having a cutting device and a shaping device to form a piece of padding from a paper web and to cut it off in a desired length, comprising an input means (18) to input a desired length of padding;

a control unit (10, 40) having a memory to control the drive motor in response to the input means (18), wherein an activation of the input means (18) starts the drive motor and a deactivation of the input means triggers a cutting procedure and stops the drive motor so that the time period of the activation of the input means corresponds to the length of padding produced, and wherein the control unit (10, 40) automatically stores said length of padding produced in the memory on deactivation of the input means (18) and makes it available for a further call up upon momentary activation of said input means such that the length of padding just produced is automatically reproduced on request.

2. A control in accordance with claim 1, wherein the stored length of padding can be called up by an actuation, in particular a brief actuation, of the input means (18) or of a further input means from the memory, with the manufacture of at least one further piece of padding being triggered automatically in the called up length on the call up of the length of padding.

3. A control in accordance with claim 1, wherein the input means is an individual switch or push button (18); and wherein an input pad (45) is provided in addition to the switch or push button (18) with which desired lengths of padding can be input into the control and/or can be called up out of the control, with the manufacture of at least one piece of padding being triggered automatically in the called up length on the call up of a length of padding.

4. A control in accordance with claim 3, wherein it permits a directly sequential call up of a respective length of padding with the switch or the push button (18), on the one hand, and with the input pad (45), on the other hand, without a further input means of the control having to be actuated between these two call ups.

5. A control in accordance with claim 3, wherein at least one additional switch or push button (22-26; 91-93; 46-50) is provided on whose actuation a standard length of padding stored in the memory is called up, with the manufacture of at least one piece of padding being triggered automatically in the called up length on the call up of the length of padding.

6. A control in accordance with claim 1, wherein a display device (90) is provided; and wherein, when the control is switched on for the first time, a standard length of padding stored in the memory is displayed which can be called up by a further input means (95, 46), with the manufacture of at least one piece of padding being triggered automatically in the called up length on the call up of the length of padding.

7. A control in accordance with claim 1, wherein it has a mode in which a combination of the desired number and of the desired length of the pieces of padding to be produced can be at least one of stored and called up.

8. A control in accordance with claim 1, wherein an input means (22-26; 30; 45) is provided with which a continuous manufacture of pieces of padding in the stored length of padding can be activated.

9. A control in accordance with claim 3, wherein the individual switch or push button (18), the input pad (48) and an input means for the activation of a continuous manufacture (30) are input means of equal priority for the call up of a length of padding, with the manufacture of at least one piece of padding being triggered automatically in the desired length on the call up of the length of padding.

10. A control in accordance with claim 1, wherein a selection switch (20) is provided with which a plurality of memory locations can be selected in the memory in which a produced length of padding can be stored automatically, with the associated stored length of padding being produced in dependence on the position of the selection switch (20), in particular on the activation of the input means (18).

11. A control in accordance with claim 10, wherein a further input means (22-26) is respectively associated with the plurality of memory locations to call up a length of padding stored at the respective memory location, with the manufacture of at least one piece of padding being automatically triggered in the called up length on the call up of the length of padding.

12. A control in accordance with claim 1, wherein a sensor is connected to it which detects the forthcoming end of the paper web; and wherein the control generates a signal in response to the sensor which in particular interrupts a further operation of the machine at least temporarily.

13. A control in accordance with claim 1, wherein it has a connector for an electromagnetic coupling of an auxiliary unit, with the control controlling the drive motor differently in dependence on whether the electromagnetic coupling is connected, with the control preferably automatically recognizing whether an electromagnetic coupling is connected.

14. A machine for the manufacture of paper padding, comprising:

a drive motor having a cutting device and a shaping device to shape a piece of padding from a paper web and to cut it off in a desired length; and a control comprising:

an input means (18) to input a desired length of padding;

a control unit (10, 40) having a memory to control the drive motor in response to the input means (18), wherein an activation of the input means (18) starts the drive motor and a deactivation of the input means triggers a cutting procedure and stops the drive motor so that the time period of the activation of the input means corresponds to the length of padding produced, and wherein the control unit (10, 40) automatically stores the length of padding produced in the memory on deactivation of the input means (18) and makes it available for a further call up upon momentary activation of said input means such that the length of padding just produced is automatically reproduced upon request.

15. A machine in accordance with claim 14, wherein the control is made as a separate operating part which is connected to the machine via a cable, wherein a holder is in particular provided at the machine for the releasable installation of the control.

16. A machine in accordance with claim 14, wherein a bus system is provided for the transmission of the control signals from the control to the machine.

* * * * *